US006454135B1

(12) United States Patent
Brozell

(10) Patent No.: US 6,454,135 B1
(45) Date of Patent: Sep. 24, 2002

(54) DUAL LIQUID DISPENSING PACKAGES

(75) Inventor: Leonora M. Brozell, Maumee, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/955,320

(22) Filed: Sep. 18, 2001

(51) Int. Cl.[7] ..... B67D 5/52
(52) U.S. Cl. ..... 222/135; 222/162; 222/183
(58) Field of Search ..... 222/94, 135, 137, 222/144.5, 145.1, 183, 131

(56) References Cited

U.S. PATENT DOCUMENTS

| | | | | |
|---|---|---|---|---|
| 3,390,940 A | | 7/1968 | Schwartzman | |
| 3,549,052 A | * | 12/1970 | Forim | 222/135 |
| 4,037,977 A | | 7/1977 | Ronai | |
| 4,708,267 A | | 11/1987 | Sieverding et al. | |
| 5,020,930 A | | 6/1991 | Kuhn | |
| 5,088,849 A | | 2/1992 | Johnson et al. | |
| 5,137,178 A | | 8/1992 | Stokes et al. | |
| 5,169,029 A | * | 12/1992 | Behar et al. | 222/135 |
| 5,213,431 A | | 5/1993 | Gentile et al. | |
| 5,224,627 A | * | 7/1993 | Weag | 222/135 |
| 5,411,176 A | | 5/1995 | Favre | |
| 5,593,065 A | | 1/1997 | Harrold | |
| 5,860,572 A | | 1/1999 | Harrold et al. | |
| 5,901,883 A | * | 5/1999 | Ritsche | 222/137 |
| 6,095,708 A | | 8/2000 | Butaud | |

* cited by examiner

*Primary Examiner*—Philippe Derakshani
*Assistant Examiner*—Thach H. Bui

(57) ABSTRACT

A package for containing and applying a two-component liquid solution includes a housing having first and second liquid chambers for containing associated liquids to be applied, and first and second liquid cartridge pumps mounted in the housing and respectively disposed in the first and second chambers. Each of the pumps has an inlet for receiving liquid from the associated chamber. A surface applicator is mounted on the housing to apply the two-component solution to a surface, such as a user's skin. A manifold is connected to the outlets of the pumps to mix the liquids from the pump outlets and direct the mixed liquids to the applicator. One of the housing and the applicator has a portion that is moveable with respect to the pumps for activating the pumps and delivering liquids from the chambers simultaneously to the applicator.

46 Claims, 4 Drawing Sheets

DUAL LIQUID DISPENSING PACKAGES

The present invention is directed to packages for containing and applying two-component liquid solutions, such as a two-component deodorant, and to liquid dispensing cartridges for use in such packages.

BACKGROUND OF THE INVENTION

A general object of the present invention is to provide a package for containing and applying a two-component liquid solution, such as a two-component liquid deodorant, in which the liquid components are separated within the package and not mixed until the time of application, and in which the absolute and relative quantities of liquid dispensed at each application are controlled by design of the package. Another object of the present invention, in accordance with specific preferred embodiments of the invention, is to provide a package of the described character in which the liquid components are provided in the form of replaceable and/or refillable cartridge assemblies.

The present invention involves a number of features or aspects that may be used separately from or, more preferably, in combination with each other. In accordance with a first aspect of the present invention, a package for containing and applying a two-component liquid solution includes a housing having first and second liquid chambers for containing associated liquids to be applied, and first and second liquid cartridge pumps mounted in the housing and respectively disposed in the first and second chambers. Each of the pumps has an inlet for receiving liquid from the associated chamber. A surface applicator is mounted on the housing to apply the two-component solution to a surface, such as a user's skin. A manifold is connected to the outlets of the pumps to mix the liquids from the pump outlets and direct the mixed liquids to the applicator. One of the housing and the applicator has a portion that is moveable with respect to the pumps for activating the pumps simultaneously and delivering liquids from the chambers to the applicator.

A package for containing and applying a two-component liquid solution in accordance with one presently preferred embodiment of the invention includes a housing having an open end and a surface applicator mounted over the open end of the housing. A manifold is mounted on an underside of the applicator within the housing for delivering liquid solution to the applicator. First and second liquid cartridge assemblies are suspended from the manifold and contain respective liquids to be applied. Each of the cartridge assemblies includes a cartridge pump having an inlet disposed within the cartridge and an outlet coupled to the manifold. The housing has a wall portion that is resiliently moveable into the housing to engage the cartridge assemblies and compress the cartridges against the manifold, thereby activating the pumps simultaneously to deliver liquids from the cartridges to the applicator. A spring within the housing engages the wall portion and biases the wall portion away from the cartridges. A stop on the wall portion limits movement of the wall portion away from the cartridges. The housing, including the wall portion, the spring and the stop, preferably are of integrally molded plastic construction.

A package for containing and applying a two-component liquid solution in accordance with another preferred embodiment of the invention includes a clamshell housing having a base portion and a lid portion pivotally coupled to each other by an integrally molded hinge. First and second liquid cartridge assemblies are secured within the base portion and contain respective liquids to be applied. Each of the cartridge assemblies includes a cartridge pump having an inlet disposed within the cartridge. A manifold on the base portion of the housing has first and second inlets respectively coupled to the outlets of the pumps. An applicator on the lid portion is connected by a flexible conduit to the outlet of the manifold. The base portion of the housing has a wall portion that is resiliently moveable into the housing against the manifold to move the manifold toward the cartridges, and thereby simultaneously activate the pumps and deliver liquid solutions from the cartridges to the applicator through the manifold and the flexible conduit. The clamshell housing and hinge are preferably of integrally molded plastic construction. The applicator may be over-molded on an exterior surface of the lid portion of the housing. The moveable wall portion of the housing is coupled to the base portion by an integrally molded hinge.

A package for containing and applying a two-component liquid solution in it accordance with a third embodiment of the invention includes an open shell having an internal wall forming separate liquid chambers within the shell. A closure plate wall extends across the open end of the shell to close the liquid chambers. First and second liquid cartridge pumps are mounted on the closure plate, and have inlets disposed in respective ones of the liquid chambers. A flexible resilient applicator is mounted on the shell overlying and spaced from the closure plate. A manifold is mounted on the underside of the applicator, having inlets coupled to the outlets of the pumps and an outlet coupled to the applicator. Resilient flexure of the applicator toward the closure plate, such as by pressing the applicator against the skin of a user, activates the pumps simultaneously to deliver liquids from the chambers to the applicator. The pumps include pump cylinders integrally extending from the closure plate, pump pistons dispose within the cylinders, and pump outlet stems extending from the cylinders to the manifold. A spring is captured, in compression in the preferred embodiment of the invention, between the closure plate and the applicator to bias the applicator away from the closure plate. Use of a single spring between the applicator and the closure plate, in place of separate springs within the cartridge pumps, reduces the pressure required for activation of the pumps.

In accordance with another aspect of the present invention, a liquid dispensing cartridge assembly includes a container or vial for holding a liquid to be dispensed and a closure secured over an open end of the vial. A cartridge pump is mounted on the closure so as to have an inlet end disposed within the vial and an outlet and extending from the closure. The pump outlet preferably includes a hollow stem extending from the closure. Such a liquid dispensing cartridge assembly may be employed as a replacement cartridge in the packages in accordance with the first and second embodiments of the invention.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 3:
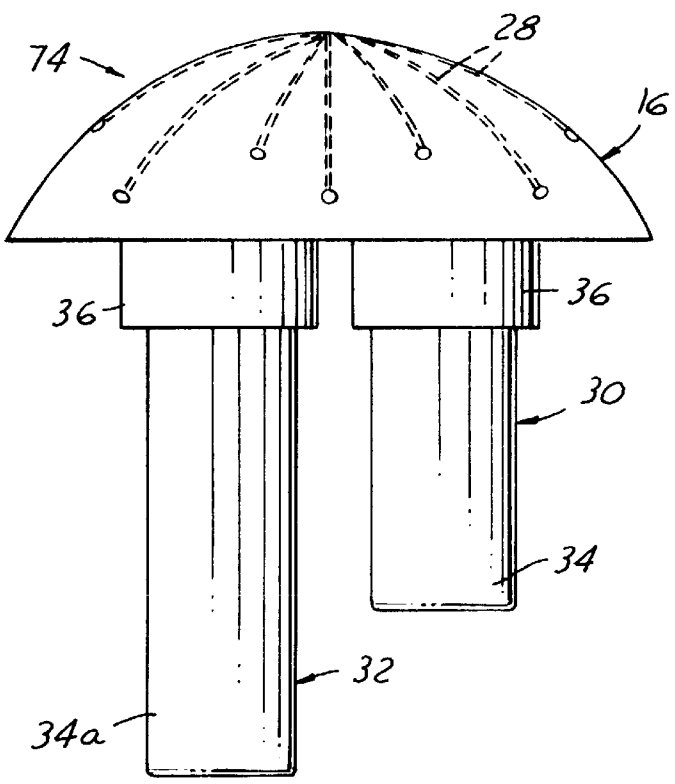
FIG. 3 is an elevational view of the applicator and cartridge subassembly in the package of FIGS. 1–2.
Figure 1:
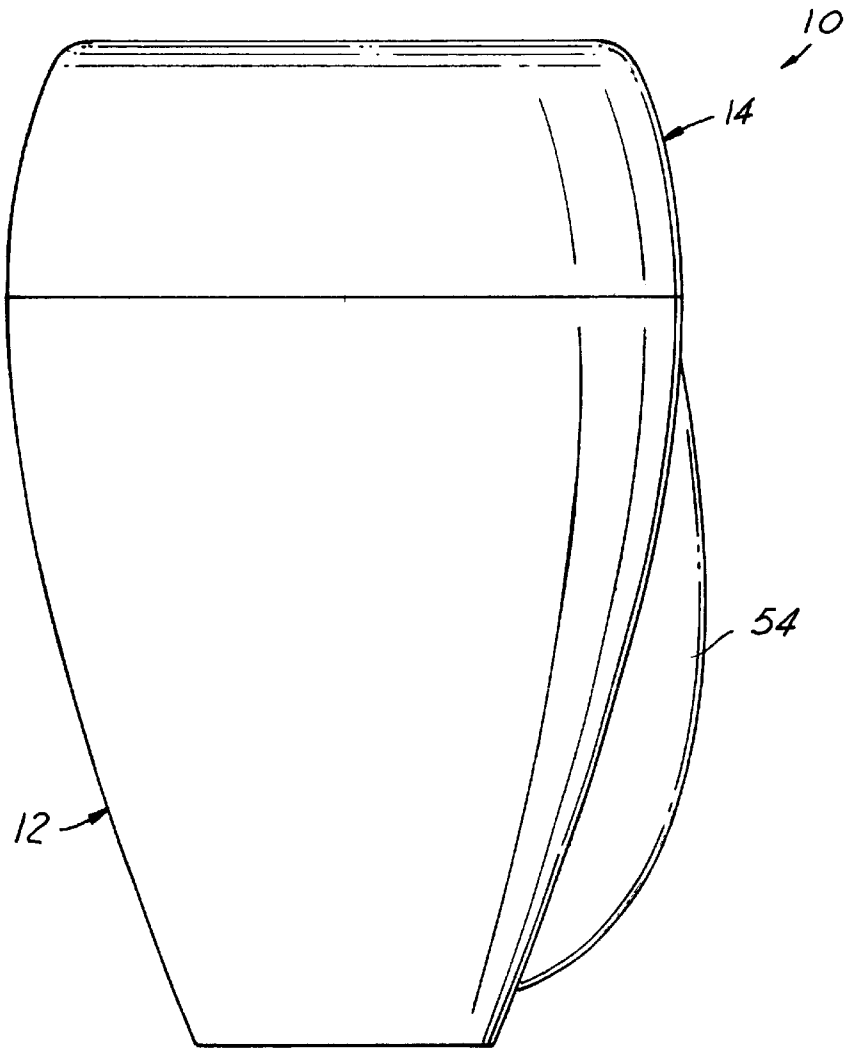
FIG. 1 is an elevational view of a package for containing and applying a two-component liquid solution in accordance with one presently preferred embodiment of the invention.
Figure 2:
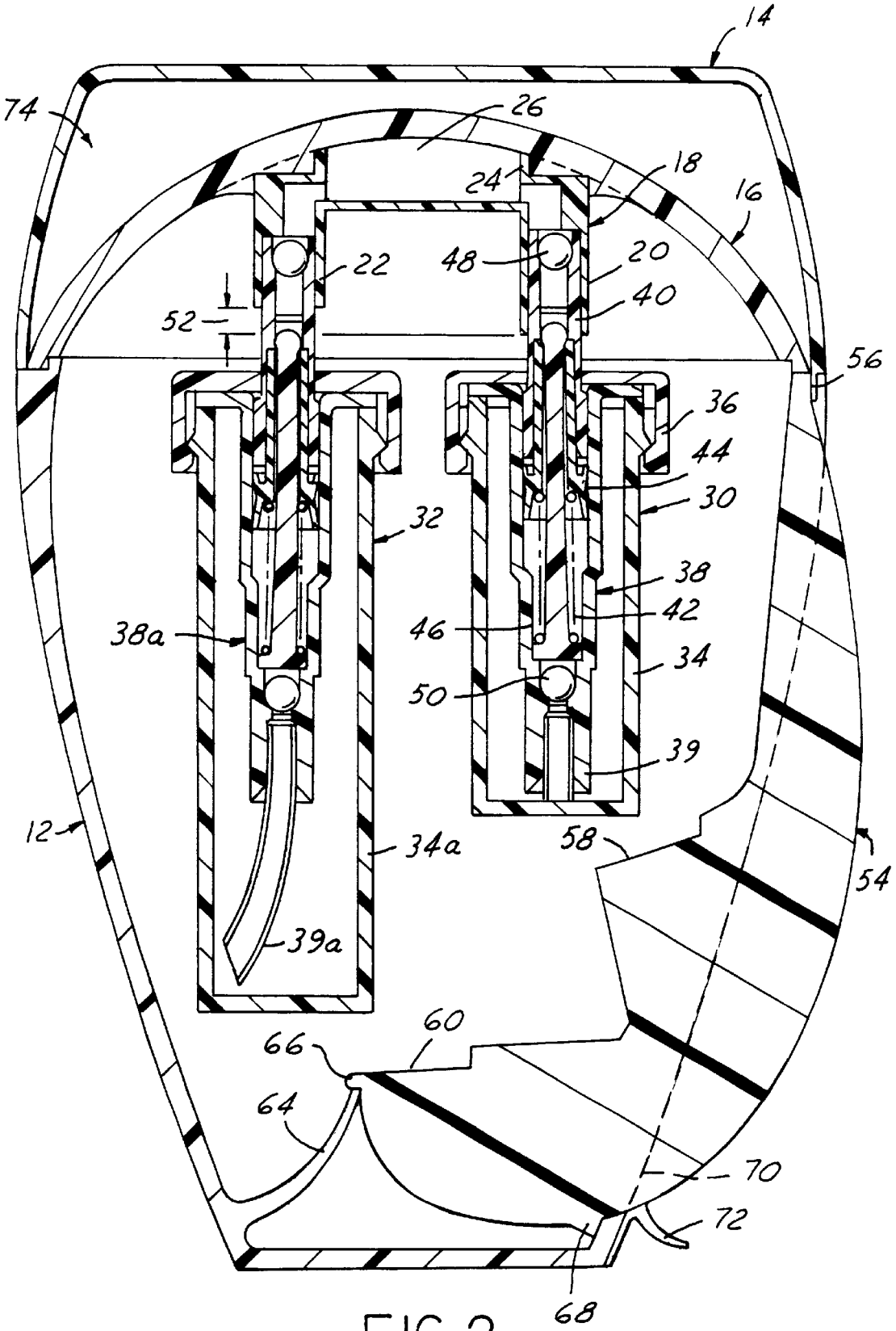
FIG. 2 is a sectional view of the package illustrated in FIG. 1.

FIGS. 1–3 illustrate a package 10 in accordance with one presently preferred embodiment of the invention as including a housing 12 and a removable cover 14. Housing 12 is cup-shaped and has an open upper end, as best seen in FIG. 2. (Directional adjectives such as "upper" are used by way of description and not limitation with respect to the orientations illustrated in the drawings.) An upwardly or outwardly convex surface applicator 16 is mounted over the open upper end of the housing. A manifold 18 is secured to the underside of applicator 16. Manifold 18 includes fluid passages in the form of an inverted Y, having laterally spaced downwardly oriented parallel inlets 20, 22 and an outlet 24 coupled to the underside of applicator 16. Manifold outlet 24 surrounds a mixing chamber 26, from which fluid is fed along the underside of applicator 16 through trenches or slots 28 (FIG. 3) on the underside of the applicator.

Manifold inlets 20, 22 are hollow and cylindrical, and extend along laterally spaced parallel axes. First and second liquid cartridge assemblies 30, 32 are suspended from manifold inlets 20, 22 respectively. Cartridge assemblies 30, 32 are laterally spaced from each other, and have coplanar parallel longitudinal axes respectively aligned with manifold inlet 20, 22. Cartridge assembly 30 includes a generally cylindrical container or vial 34 having an open upper end, and a closure 36 that closes the open upper end of the vial. A cartridge pump 38 is carried by closure 36 by being clamped between closure 36 and the open upper end of vial 34. Cartridge pump 38 is of generally conventional construction. Pump 38 has an inlet end 39 disposed within vial 34 adjacent to its lower end, and an outlet end in the form of a hollow stem 40 press fitted into manifold inlet 20. In general, upon compression of cartridge assembly 38 adjacent manifold 18 against the force of cartridge pump spring 42, liquid is dispensed by piston 44 within cylinder 46 around check ball 48. Upon release of the cartridge, liquid is drawn from within vial 34 past check ball 50 preparatory to the next compression of the cartridge pump. The internal structure and operation of the cartridge pump are well known in the art, and are described in greater detail in the above-noted patents.

Second cartridge assembly 32 is generally similar to cartridge assembly 30, except that vial 34*a* is longer than vial 34, and inlet 39*a* of pump 38*a* is formed by a dip tube that extends to the lower end of the elongated vial. It will also be noted that there is a difference 52 in strokes between the respective cartridge assemblies 30, 32, which controls a difference in dosage between the two pumps. Thus, in this example, approximately twice as much liquid will be discharged from cartridge assembly 32 as compared with cartridge assembly 30 upon simultaneous activation of both pumps. Cartridge vial 34*a* is elongated so as to hold twice as much liquid as cartridge vial 34, so that the two cartridges assemblies will empty after approximately the same time and after approximately the same number of strokes. The sizes of the cartridge assemblies and the difference 52 in the strokes are set at the time of package design depending upon the desired ratio of liquid to be dispensed. If equal liquid quantities were desired, the cartridge assemblies would preferably be the same size and the strokes would be equal.

Housing 12 has a button wall portion 54 that is hinged at 56 to the body of the housing. Button wall portion 54 has a first flat land area 58 within housing 12 disposed for abutment with the lower end of pump cartridge assembly 30 upon movement of the button into the housing, and a second flat land area 60 disposed for end-wise abutment with cartridge assembly 32. An arcuate spring 64 is molded into housing 12 adjacent to the lower end thereof, and extends upwardly and inwardly to engage a stop 66 at the end of button wall portion 54. Spring 64 is slightly compressed to hold the button wall portion in position. A stop 68 is also molded into the arcuate undersurface of the button wall portion for engaging an opposing inside edge of housing 12 surrounding the housing opening 70 through which button wall portion 54 extends. A removable tab 72 extends along the exterior surface of housing 12 adjacent to the lower end of button wall portion 54 to function as a shipping seal—i.e., to prevent inward movement of button wall portion 54 during shipping and handling of the package prior to intended use. Housing 12, including button wall portion 54, hinge 56, spring 64, stops 66, 68 and tab 72, is preferably of integrally molded plastic construction. Cover 14 and manifold 18 are also preferably of molded plastic construction. Button wall portion 54 is molded in a position extending outward from housing 12, and is moved to the position of FIGS. 1–2 in a post-molding operation. Applicator 16 may be of molded or sintered plastic construction, or may comprise a relatively rigid molded plastic base and an overlying layer of foam or the like through which the mixed liquids may travel by wicking or capillary action.

To apply liquid product from package 10, tab 72 is removed, and button wall portion 54 is pivoted above hinge 56 into the body of housing 12 so that land areas 58, 60 engage the lower ends of cartridge assemblies 30, 32. Continued inward movement of button wall portion 54 compresses the cartridge assemblies against manifold 18 so that liquid is pumped from each cartridge assembly, by the associated cartridge pump 38, 38*a*. The liquids travel through pump outlet stems 40 to manifold inlets 20, 22, and thence through mixing chamber 26 to trenches or grooves 28 on the underside of applicator 16. The liquid solutions, which are mixed in chamber 26 prior to application, travel through the applicator by wicking or capillary action for application to the skin of a user, for example. As button wall portion 54 moves into the house to activate the cartridge assemblies, the button wall portion pushes against spring 64. Such inward movement is resisted initially by housing spring 64, and by spring 64 combined with cartridge pump springs 42 after flats 58, 60 engage vials 34, 34*a*. The ends of the strokes of cartridge pumps 38, 38*a* act as a stop against further movement of button wall portion 54 into the housing. When the button wall portion is released, spring 64 moves the button wall portion to its initial position illustrated in FIGS. 1 and 2, at which the button wall portion is held by stops 66, 68.

A particular feature of the embodiment illustrated in FIGS. 1–3 (and the embodiment illustrated in FIGS. 4–5) is that liquid cartridge assemblies 30, 32 may be refilled or replaced when they become empty. That is, when the cartridges are empty, the subassembly 74 of applicator 16, manifold 18 and liquid cartridge assemblies 30, 32 (FIG. 3) may be removed from housing 12. Liquid cartridge assemblies 30, 32 may be removed from manifold 18 by pulling outlet stems 40 out of manifold inlets 20, 22. The liquid cartridge assemblies may then be simply replaced by refill cartridge assemblies, or the cartridge assemblies themselves may be refilled by removing closures 36 from vials 34, 34*a* and refilling the vials with the appropriate liquids. The closure and pump may then be reassembled to the vial, liquid cartridge assemblies 30, 32 may be reassembled to manifold 18, and subassembly 74 of applicator 16, manifold 18 and liquid cartridge assembly 30, 32 may be reassembled to housing 12.

Figure 4:
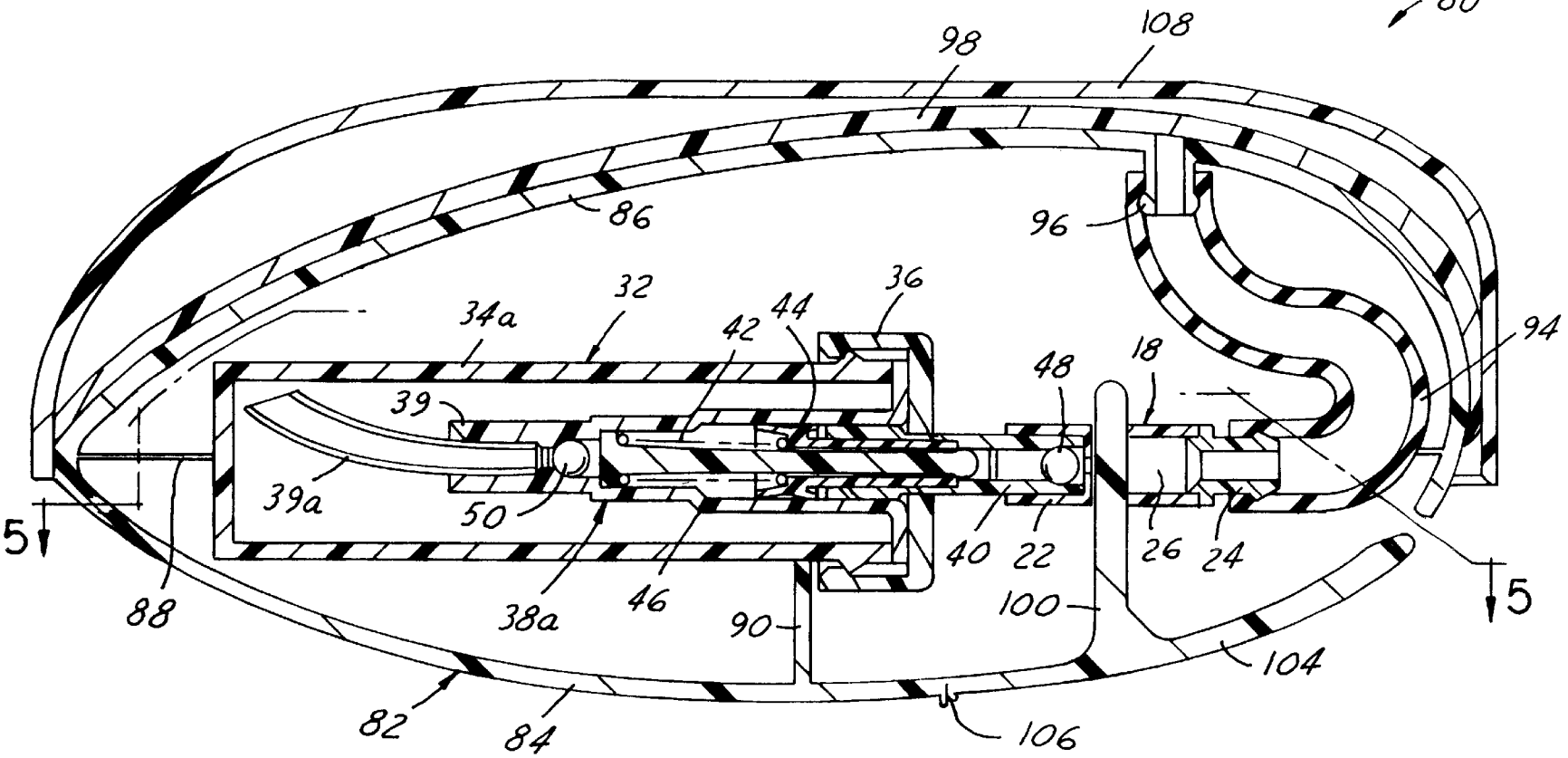
FIG. 4 is a sectional view in side elevation of a package in accordance with another embodiment of the invention.
Figure 5:
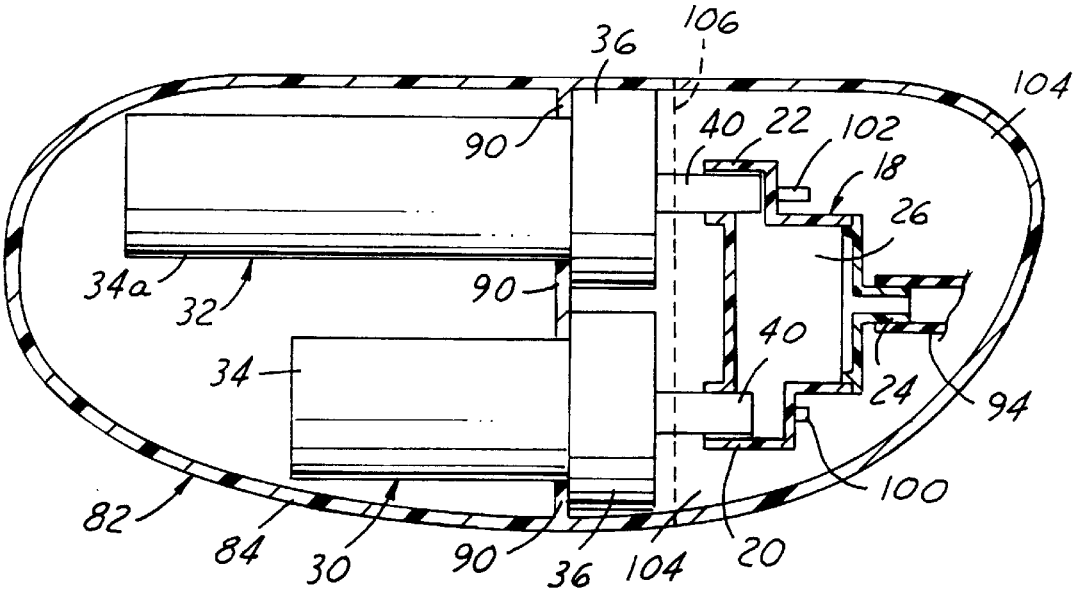
FIG. 5 is a sectional plan view of the base portion of the package in FIG. 4, being taken substantially along the line 5–5 in FIG. 4.

FIGS. 4 and 5 illustrate a package 80 in accordance with a second presently preferred embodiment of the invention. Package 80 includes a clamshell housing 82 having a base portion 84 and a lid portion 86 interconnected by an integral hinge 88 that extends along one long edge of the housing. Base portion 84 of clamshell housing 82 includes an upstanding wall 90 (in the orientation of FIG. 4) on which liquid cartridge assemblies 30, 32 are removably mounted. (Reference numerals in FIGS. 4–6 that are identical to those issued in FIGS. 1–3 indicate identical or related components.) Manifold 18 is mounted on outlet stems 40 of cartridge assemblies 30, 32. Outlet 24 of manifold 18 is connected by a flexible hose or conduit 94 to a fitting 96 (FIG. 4) that extends inwardly from lid portion 86 of housing 82. An applicator 98 extends over the outside surface of lid portion 86, and receives liquid to be applied through conduit 94 and fitting 96. Base portion 84 of clamshell housing 82 includes a button wall portion 104 connected to the remainder of the base by an integral hinge 106. Button wall portion 104 has a pair of laterally spaced upstanding legs 100, 102 (FIGS. 4 and 5) that engage manifold 18 in opposition to cartridge assemblies 30, 32 supported by base wall 90. Cartridge assemblies 30, 32 again have coplanar parallel longitudinal axes respectively aligned with manifold inlet 20, 22.

Thus, when button wall portion 104 is pivoted by a user counterclockwise in FIG. 4 about the lateral axis of hinge 106, manifold 18 is moved to the left in the orientations of FIGS. 4 and 5 to activate the cartridge pumps within the cartridge assemblies and pump liquid from within the respective cartridge assemblies into mixing chamber 26 of manifold 18. Liquid under pressure is fed through conduit 94 and fitting 96 to applicator 98 on the outer surface of lid 86. The outer surface of the lid may include suitable channels to help distribute the liquid. In the meantime, when button wall portion 104 is released, the manifold is returned to its original position as shown in FIGS. 4 and 5 by pump springs 42. A cup-shaped lid 108 covers applicator 98 when not in use. Clamshell housing 82, including base portion 84, lid portion 86, hinge 88, button wall portion 104, legs 100, 102 and hinge 106, is preferably of integrally molded plastic construction. Applicator 98 may be over-molded onto the outer surface of lid portion 86, or may be affixed to the lid portion of the housing by suitable alternative techniques. Liquid cartridge assemblies 30, 32 may be replaced or refilled when empty by opening the clamshell housing and removing the cartridges. Conduit 94 is sufficiently long to accommodate opening of the clamshell housing.

Figure 6:
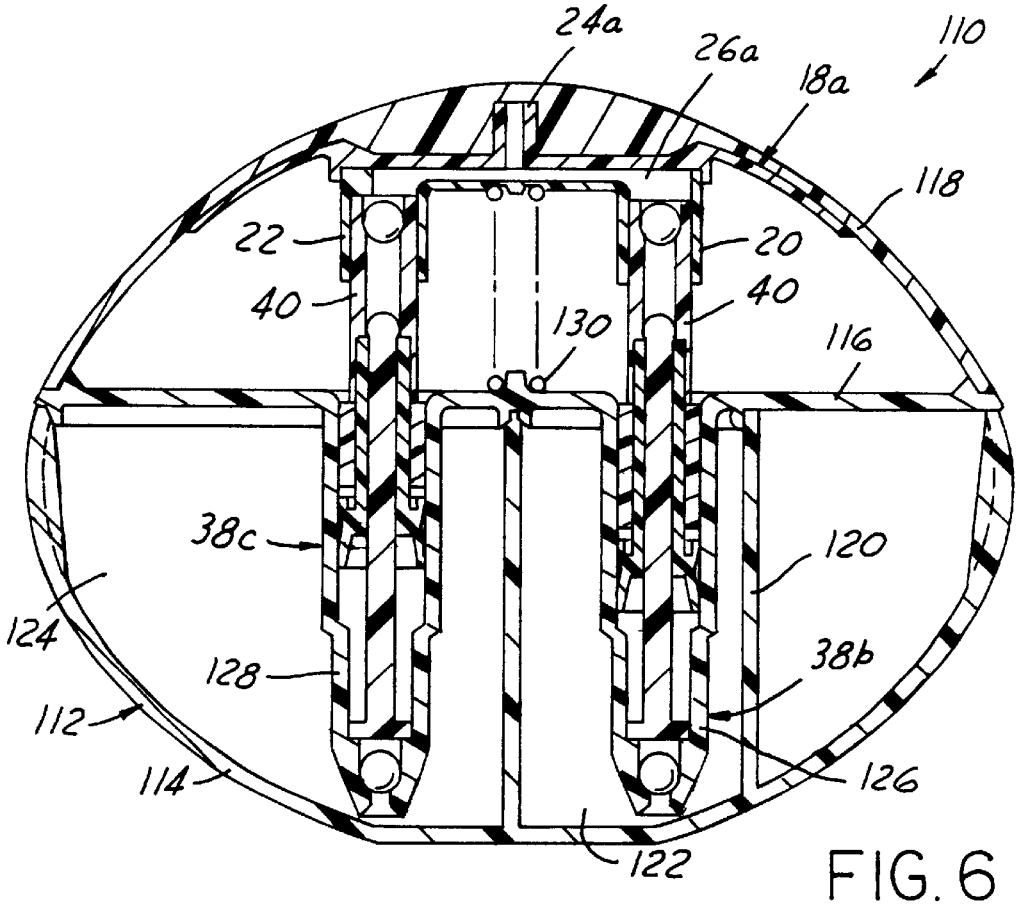
FIG. 6 is an end sectional view of a package in accordance with a third embodiment of the invention.

FIG. 6 illustrates a package 110 in accordance with a third embodiment of the present invention. A housing 112 includes an open cup-shaped base or shell 114, a closure plate 116 that extends across the open end of shell 114, and an inverted cup-shaped resilient flexible applicator 118 mounted on shell 114 overlying and spaced from closure plate 116. (The package also includes a removable cup-shaped cover over application 118, which is not illustrated in FIG.6.) An internal wall 120 in shell 114 forms a pair of separate liquid-containing chambers 122, 124 that are closed by closure plate 116. Closure plate 116 has a pair of pockets 126, 128 that are respectively disposed within chambers 122, 124 and form the cylinders of a pair of cartridge pumps 38*b*, 38*c*. Cartridge pumps 38*b*, 38*c* are essentially the same as cartridge pumps 38, 38*a* in FIG. 2, except that the outer cylinders of the pumps are formed by closure plate 116, and pump springs 42 (FIG. 2) have been eliminated in FIG. 6. The inlet ends of cartridge pumps 38*b*, 38*c* are disposed adjacent to the bottom of shell 114 (in the orientation of FIG. 6). A manifold 18*a* is secured to the underside of applicator 118, having inlets 20, 22 that receive the outlet stems 40 of cartridge pumps 38*b*, 38*c*, and an outlet 24*a* that feeds mixed liquids into the body of applicator 118. Manifold inlets 20,22 are axially aligned with cylinder pockets 126, 128 in plate 116 along parallel coplanar axes. A coil spring 130 is captured in compression between the underside of manifold 18*a* and the opposing surface of closure plate 116 between pumps 38*b*, 38*c*. Applicator 118 in this embodiment is of flexible resilient construction, permitting collapse of applicator 118 toward closure plate 116 against the force of spring 130 to dispense liquid product from chambers 122, 124.

That is, when it is desired to dispense liquid products, applicator 118 is placed against an appropriate portion of the user's skin, for example, and shell 114 is compressed toward the applicator against the force of spring 130. As spring 130 is compressed, liquid is pumped by cartridge pumps 38*b*, 38*c* into applicator 118. In this embodiment, chamber 124 is larger than chamber 122, and the piston stroke of pump 38*c* is greater than that of pump 38*b*. As in the other embodiments, the chamber sizes and pump strokes are tailored to accommodate the desired ratio of liquids to be dispensed. When shell 114 is released and manifold 18*a* and applicator 118 move to the positions of FIG. 6, liquid is drawn into the cartridge pumps from chambers 122, 124 preparatory to the next application. As in the prior embodiments, the liquids are not mixed until reaching chamber 26*a* in manifold 18*a* immediately prior to dispensing to the applicator. Use of a single coil spring 130 in place of the pair of springs in the cartridge pumps helps reduce the force necessary to apply the liquid. Furthermore, the spring never touches the product to be dispensed. Spring 130 may be molded into closure plate 116 or manifold 18*a*. The package may be sized to be held in the palm of a user's hand, like a bar of soap.

There have thus been disclosed a package for containing and applying a two-component liquid solution, and cartridge assembles for use in such a package, that fully satisfy all of the objects and aims previously set forth. The invention has been disclosed in conjunction with presently preferred embodiments thereof, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A package for containing and applying a two-component liquid solution, which comprises:

a housing having first and second liquid chambers for containing associated liquids to be applied, first and second liquid cartridge pumps mounted in said housing, each of said pumps having an inlet respectively disposed in said first and second chambers for receiving liquid from the associated chamber and an outlet, a surface applicator on said housing, a manifold connected to said pump outlets to mix liquids from said pump outlets and direct the mixed liquids to said applicator, and one of said housing and said applicator having a portion that is moveable with respect to said pumps for activating said pumps and delivering liquids from said chambers simultaneously to said applicator, said housing comprising a closed housing, having said pumps and said manifold within said housing and said applicator on one wall of said housing.

2. The package set forth in claim 1 wherein said liquid chambers comprise liquid cartridge assemblies coupled to said manifold.

3. The package set forth in claim 2 wherein said liquid cartridge assemblies are removably coupled to said manifold.

4. The package set forth in claim 3 wherein said liquid cartridge assemblies each comprise a vial for holding a liquid to be dispensed, a closure secured to said vial and one of said pumps mounted on said closure so as to have its inlet disposed within said vial and its outlet projecting from said closure for connection to said manifold.

5. The package set forth in claim 1 wherein said liquid chambers comprise separate portions of said housing.

6. The package set forth in claim 1 wherein said cartridge pumps have different strokes for dispensing differing quantities of liquid solution from said chambers upon each simultaneous activation of said pumps.

7. The package set forth in claim 1 wherein said housing comprises a closed housing having said pumps and said manifold within said housing and said applicator on one wall of said housing.

8. The package set forth in claim 1 wherein said housing comprises a cup-shaped housing having an open end, and wherein said applicator is mounted to said housing to close said open end of said housing.

9. The package set forth in claim 8 wherein said applicator is flexible and resilient, compression of said applicator with respect to said housing activating said pumps simultaneously and delivering liquids from said chambers to said applicator.

10. The package set forth in claim 9 wherein said housing comprises an open shell having a wall forming separate liquid chambers within said shell, and a closure plate extending across said open shell to close said chambers and support said pumps with said pump inlets disposed in said chambers, and wherein said flexible resilient applicator is mounted to said housing overlying and spaced from said closure plate and said manifold is mounted on said applicator.

11. The package set forth in claim 10 wherein said pumps include pump cylinders integrally extending from said closure plate, pump portions wherein said cylinders, and pump outlet stems extending from said cylinders to said manifold.

12. The package set forth in claim 11 further comprising a spring captured in compression between said closure plate and said applicator to bias said applicator away from said closure plate.

13. The package set forth in claim 12 wherein said spring comprises a coil spring.

14. The package set forth in claim 8 wherein said manifold and said pumps are suspended from said applicator, and wherein said housing includes a wall portion that is resiliently moveable into said housing to engage said pumps and activate said pumps simultaneously for delivering liquids from said chambers to said applicator.

15. The package set forth in claim 14 wherein said wall portion is connected to said housing by an integrally formed hinge.

16. The package set forth in claim 15 further comprising a spring in said housing engaging said wall portion and biasing said wall portion away from said pumps.

17. The package set forth in claim 16 further comprising a stop on said wall portion to limit movement of said wall portion away from said pumps.

18. The package set forth in claim 17 wherein said housing, including said wall portion, said spring and said stop, are of integrally molded plastic construction.

19. The package set forth in claim 18 wherein said liquid chambers comprise liquid cartridge assemblies that include said pumps, said pumps having outlet stems that are received in said manifold to suspend said cartridge assemblies from said manifold.

20. The package set forth in claim 1 wherein said chambers and said pumps are secured in fixed position within said housing, wherein said manifold is connected by a flexible conduit to said applicator, and wherein said housing includes a wall portion that is resiliently moveable into said housing against said manifold to move said manifold toward said chamber and thereby simultaneously deliver liquid solutions from said chambers to said applicator.

21. The package set forth in claim 20 wherein said housing comprises a clamshell having a base portion on which said chambers, said pumps and said manifold are mounted, and on which said moveable wall portion is disposed, and a lid portion on which said applicator is disposed, said conduit connecting said manifold on said base portion to said applicator on said lid portion.

22. The package set forth in claim 21 wherein said housing clamshell, including said base portion, said lid portion and a hinge connecting said base and lid portions, is of integrally molded plastic construction.

23. The package set forth in claim 22 wherein said applicator is over-molded on an exterior of said lid position.

24. The package set forth in claim 22 wherein said moveable wall portion is coupled to said base portion by an integrally molded hinge.

25. A package for containing and applying a two-component liquid solution, which comprises:

a housing having an open end, a surface applicator mounted over said open end of said housing, a manifold on an underside of said applicator within said housing for delivering liquid solution to said applicator, and first and second liquid cartridge assemblies suspended from said manifold and containing respective liquids to be applied, each of said cartridge assemblies including a cartridge pump having an inlet disposed within the cartridge assembly and an outlet coupled to said manifold, such housing having a wall portion that is resiliently movable into said housing to engage said cartridge assemblies and compress said pumps against said manifold simultaneously to deliver liquids from said cartridge assemblies to said applicator.

26. The package set forth in claim 25 wherein said liquid cartridge assemblies are removably suspended from said manifold.

27. The package set forth in claim 26 wherein said liquid cartridge assemblies each comprise a vial for holding a liquid to be dispensed, a closure secured to said vial and one of said pumps mounted on said closure so as to have its inlet disposed within said vial and its outlet projecting from said closure for connection to said manifold.

28. The package set forth in claim 25 wherein said cartridge pumps have different strokes for dispensing differing quantities of liquid solution from said cartridge assemblies.

29. The package set forth in claim 25 wherein said wall portion is connected to said housing by an integrally formed hinge.

30. The package set forth in claim 29 further comprising a spring in said housing engaging said wall portion and biasing said wall portion away from said cartridge assemblies.

31. The package set forth in claim 30 further comprising a stop on said wall portion to limit movement of said wall portion away from said cartridge assemblies.

32. The package set forth in claim 31 wherein said housing, including said wall portion, said spring and said stop, are of integrally molded plastic construction.

33. The package set forth in claim 32 wherein said pumps having outlet stems that are received in said manifold to suspend said cartridge assemblies from said manifold.

34. A package for containing and applying a two-component liquid solution, which comprises:

a clamshell housing having a base portion and a lid portion pivotally coupled to each other by an integrally molded hinge, first and second liquid cartridge assemblies secured within said base portion and containing respective liquids to be applied, each of said cartridge assemblies including a cartridge pump having an inlet disposed within the cartridge and an outlet, a manifold on said base portion having first and second inlets respectively coupled to said pump outlets and an outlet, an applicator on said lid portion, and a flexible conduit connecting said manifold outlet to said applicator, said base portion having a wall portion that is resiliently moveable into said housing against said manifold to move said manifold toward said cartridge assemblies and thereby simultaneously activate the pumps and deliver liquid solutions from said cartridge assemblies to said applicator through said manifold and said flexible conduit.

35. The package set forth in claim 34 wherein said liquid cartridge assemblies are removably coupled to said manifold.

36. The package set forth in claim 35 wherein said liquid cartridge assemblies each comprise a vial for holding a liquid to be dispensed, a closure secured to said vial and one of said pumps mounted on said closure so as to have its inlet disposed within said vial and its outlet projecting from said closure for connection to said manifold.

37. The package set forth in claim 34 wherein said cartridge pumps have different strokes for dispensing different quantities of liquid solution from said chambers.

38. The package set forth in claim 34 wherein said housing clamshell, including said base portion, said lid portion and a hinge connecting said base and lid portions, is of integrally molded plastic construction.

39. The package set forth in claim 38 wherein said applicator is over-molded on an exterior of said lid positions.

40. The package set forth in claim 38 wherein said moveable wall portion is coupled to said base portion by an integrally molded hinge.

41. A package for containing and applying a two-component liquid solution, which comprises:

an open shell having an internal wall forming separate liquid chambers within said shell, a closure plate extending across said open shell to close said chambers, first and second liquid cartridge pumps on said closure plate having inlets disposed in respective ones of said chambers and outlets, a flexible resilient applicator mounted on said shell overlying and spaced from said closure plate, and a manifold mounted on said applicator having inlets coupled to said pump outlets and an outlet coupled to said applicator, resilient flexure of said applicator toward said closure plate activating said pumps simultaneously to deliver liquids from said chambers to said applicator.

42. The package set forth in claim 41 wherein said cartridge pumps have different strokes for dispensing differing quantities of liquid solution from said chambers.

43. The package set forth in claim 41 wherein said pumps include pump cylinders integrally extending from said closure plate, pump portions within said cylinders, and pump outlet stems extending from said cylinders to said manifold.

44. The package set forth in claim 43 further comprising a spring captured in compression between said closure plate and said applicator to bias said applicator away from said closure plate.

45. The package set forth in claim 44 wherein said spring comprises a coil spring.

46. A package for containing and applying a two-component liquid solution, which comprises:

a housing having first and second liquid chambers for containing associated liquids to be applied, first and second liquid cartridge pumps mounted in said housing, each of said pumps having an inlet respectively disposed in said first and second chambers for receiving liquid from the associated chamber and an outlet, a surface applicator on said housing, a manifold connected to said pump outlets to mix liquids from said pump outlets and direct the mixed liquids to said applicator, and one of said housing and said applicator having a portion that is moveable with respect to said pumps for activating said pumps and delivering liquids from said chambers simultaneously to said applicator, said cartridge pumps having different strokes for dispensing differing quantities of liquid solution from said chambers upon each simultaneous activation of said pumps.

* * * * *